US006833815B2

(12) United States Patent
Apostolos

(10) Patent No.: US 6,833,815 B2
(45) Date of Patent: Dec. 21, 2004

(54) CAVITY EMBEDDED MEANDER LINE LOADED ANTENNA

(75) Inventor: John T. Apostolos, Merrimac, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 271 days.

(21) Appl. No.: 10/251,131

(22) Filed: Sep. 20, 2002

(65) Prior Publication Data

US 2004/0056801 A1 Mar. 25, 2004

(51) Int. Cl.[7] ..... H01Q 1/38
(52) U.S. Cl. ..... 343/700 MS; 343/744; 343/749
(58) Field of Search ..... 343/700 MS, 741, 343/744, 749, 829, 846

(56) References Cited

U.S. PATENT DOCUMENTS 5,790,080 A 8/1998 Apostolos
6,313,716 B1 11/2001 Apostolos
6,323,814 B1 11/2001 Apostolos
6,373,440 B2 4/2002 Apostolos
6,373,446 B2 4/2002 Apostolos
6,404,391 B1 6/2002 Apostolos
6,469,675 B1 * 10/2002 Jo et al. ..... 343/744
6,480,158 B2 11/2002 Apostolos
6,489,925 B2 * 12/2002 Thursby et al. ..... 343/700 MS
6,492,953 B2 12/2002 Apostolos
6,597,321 B2 * 7/2003 Thursby et al. ..... 343/744
6,724,347 B2 * 4/2004 Tomomatsu ..... 343/700 MS

* cited by examiner

*Primary Examiner*—Shih-Chao Chen
(74) *Attorney, Agent, or Firm*—Daniel J. Long; Robert K. Tendler

(57) ABSTRACT

A wideband meander line loaded antenna is configured to be flush mounted to a conductive surface serving as a ground plane by embedding the meander line components within a conductive cavity surrounded at its top edge by the ground plane. The antenna thus looks out of a cavity recessed in the surface. By permitting flush mounting the meander line antenna, not only can the antenna dimensions be minimized due to the use of the meander line loaded antenna configuration, but in aircraft applications no part of the antenna exists above the skin of the aircraft, thereby to minimize turbulent flow. Moreover, when adapted to wireless handsets or laptop computers, the depth or thickness of the unit need not be increased when providing a wideband antenna, thus to minimize the overall dimensions of the device. Additionally, the flush mounted meander line antenna when utilized in the roof of a vehicle such as a car does not result in an unsightly protrusion from the top of the car, but rather is hidden in the recessed cavity, thereby permitting providing the vehicle with a wideband antenna which covers not only cellular frequencies but also the PCS band, the 802.11 band and GPS frequencies.

19 Claims, 5 Drawing Sheets

CAVITY EMBEDDED MEANDER LINE LOADED ANTENNA

FIELD OF INVENTION

This invention relates to meander line loaded antennas in more particularly to a configuration of the meander line loaded antenna involving a cavity and embedding the antenna in the cavity, thereby permitting flush mount operation.

BACKGROUND OF THE INVENTION

In the past, and as illustrated in U.S. Pat. No. 6,323,814 by John T. Apostolos, entitled Wideband Meander Line Loaded Antenna, assigned to the assignee hereof, and incorporated herein by reference, wide bandwidth miniaturized antennas can be provided through the utilization of planner conductors which are fed through a so-called meander line which involves impedance changes to reduce the physical size of the antenna while at the same time permitting wideband operation.

The plates of the meander line loaded antennas are configured to exist above a ground plane and are spaced therefrom, with a meander line connecting a top plate or element to the ground plane. For operation in the 225 MHz to 2 GHz range, the height of the plates which are spaced from the ground plane can exceed five inches. Were the meander line loaded antennas operate down to 100 MHz, then the height above the ground plane would be on the order of ten inches.

For vehicle top applications when using an above-the-ground plane meander line loaded antenna, a ten-inch or more dome would have to be employed on the car top which is both unsightly and which can increase turbulent flow behind the antenna at vehicle speeds.

When these antennas are utilized on supersonic aircraft, anything having hard edges and existing above the skin of the fuselage results in intolerable turbulence which cuts down the efficiency of the aircraft.

In the past, for aircraft operation, a flush-mounted crossed slot antenna has been utilized in which slots depend down into a cavity some five inches. However in the application the overall size of the antenna is 30×30 inches. As a result, these yard square antennas require a significant amount of real estate on the skin of the aircraft, which real estate is in short supply.

There is therefore need to provide a small wideband flush mount antenna which does not affect aircraft aerodynamics while at the same time providing the required wideband performance.

Whether for a cell phone, PCS, 802.11 and/or GPS application such as that which is required for either hand held wireless communication devices or for use in vehicle mounted apparatus, or for use in either satellite communications from an aircraft or for VHF communications from the aircraft to the ground, what is required is an exceedingly small flush mount antenna which has a wideband frequency response.

Such a wideband frequency response is possible with the apparatus described in U.S. Pat. No. 6,323,814 and more particularly in co-pending patent application Ser. No. 10/123,787, filed Apr. 16, 2002 assigned to the assignee hereof the incorporated herein by reference. In this patent application the low frequency cut off of the meander line loaded antenna is decreased due to a cancellation of the reactance of the antenna by the reactance of the meander line and parasitic capacitance.

It was not at all obvious that a meander line loaded antenna in which the plates of the antenna existed above a ground plane could be submerged in a conductive cavity. It was also not immediately obvious that one could obtain the reactance cancellation obtainable in an above-the-ground plane meander line loaded antenna when using any kind of cavity.

Note, when others have attempted to flush mount antennas, the size of the cavities involved were such to preclude their use due to the massive size of the cavity involved.

Also, it was not clear that the gain of the antenna at the zenith and horizon would match the same characteristics as those of an above-the-ground plane meander line loaded antenna, especially when in a loop mode. It will be appreciated that having a horizon gain that approximates that of the gain at the zenith is quite important for omnidirectional general coverage for the antenna. For instance, if one is in a vehicle and one wants coverage at the horizon where cell sites are located, then it is important that the gain in the horizontal direction be such as to robustly communicate with the cell sites.

Moreover, if the antenna is utilized in a GPS mode, it will be appreciated that the horizontal dilution of position is much smaller when signals comes from satellites at or near the horizon, as opposed to satellites which are directly overhead. Thus, the gain of the antenna towards the horizon is indeed a critical factor and one which could not be predicted from a meander line antenna with a plate above its ground plane.

Thus, it is important for flush mount applications to be able to replace the crossed-slot flush mount antenna which is a yard by a yard in area with one with considerably reduced dimensions. This type of real estate savings is indeed important not only in aircraft but also in terrestrial vehicles where appearance is important.

SUMMARY OF THE INVENTION

In the subject invention a flush-mounted meander line loaded antenna is identical in size and design to the meander line loaded antenna described above except for the location of the elements in a conductive cavity. As a result, the antenna is built at the top portion of the conductive cavity such that the top plates of the antenna are flush with a surrounding ground plane surface that meets the upper edge of the cavity. It is a feature of the subject invention that the meander line loaded antenna elements are at or below the plane of the conductive surface which carries the cavity. It is also important that the cavity volume be designed to be greater than 0.003 times the cube of the lowest frequency wavelength so as to guarantee maximum efficiency. It has been found that the subject cavity mounted antenna is governed by the Chu-Harrington relationship in which a form factor times Q, the quality factor, multiplied by the volume of the cavity divided by the cube of the wavelength in fact establishes maximum efficiency.

The way the cavity configuration is designed is to design the antenna conventionally and then having the dimensions of its top plates design a cavity whose volume is optimum as established by Chu-Harrington.

It will be appreciated that the Chu-Harrington relationship was developed for antennas which existed above a ground plane. It is the finding of the subject invention that a similar relationship holds for below ground plane antennas.

Moreover, it has been found that the gain at the zenith of the antenna and the gain at the horizon mimics exactly that of meander line loaded antennas in which the plates are above the ground plane.

What this means is that a flush mount antenna may be provided either for vehicles or aircraft, or indeed for handheld or portable devices such as laptop computers in which the antenna characteristics match those of prior meander line loaded antennas. These prior meander line loaded antennas are characterized by their small size and wideband characteristics. With the subject antenna, not only are these characteristics maintained, the flush mounting reduces the turbulent flow over the antennas, so they can be conveniently mounted on a vehicle or an aircraft.

Moreover, for wireless handsets and laptops these devices may be made thinner due to the fact that parts of the antenna may be submerged into the interior of the device. Additionally, antennas which are flush mounted in this manner are not easily broken off due to usage or mishandling.

It will be appreciated especially with regard to handheld wireless units that the whip antennas normally used are easily broken and is a cause major consternation for the user. Such breakage is avoided by the subject flush-mounted antennas. Likewise, for antennas which are mounted on relatively heavy devices such as laptops, placing them on a table or adjacent some other piece of equipment may result in damage to a surface-mounted antenna or the antenna may be broken off. Here again, the subject submerged antennas are not subject to this type of damage.

With the subject flush mount antenna, aside from the advantages of flush mounting, not only is the size minimized and the antenna characteristics maximized, the ruggedness of the unit is not compromised through the utilization of the antenna.

In summary, a wideband meander line loaded antenna is configured to be flush mounted to a conductive surface serving as a ground plane by embedding the meander line components within a conductive cavity surrounded at its top edge by the ground plane. The antenna thus looks out of a cavity recessed in the surface. By permitting flush mounting the meander line antenna, not only can the antenna dimensions be minimized due to the use of the meander line loaded antenna configuration, but in aircraft applications no part of the antenna exists above the skin of the aircraft, thereby to minimize turbulent flow. Moreover, when adapted to wireless handsets or laptop computers, the depth or thickness of the unit need not be increased when providing a wideband antenna, thus to minimize the overall dimensions of the device. Additionally, the flush mounted meander line antenna when utilized in the roof of a vehicle such as a car does not result in an unsightly protrusion from the top of the car, but rather is hidden in the recessed cavity, thereby permitting providing the vehicle with a wideband antenna which covers not only cellular frequencies but also the PCS band, the 802.11 band and GPS frequencies.

BRIEF DESCRIPTION OF THE DRAWINGS

These and other features are the subject invention will be better understood in connection with the Detailed Description in conjunction with the Drawings, of which.

DETAILED DESCRIPTION

Figure 1:
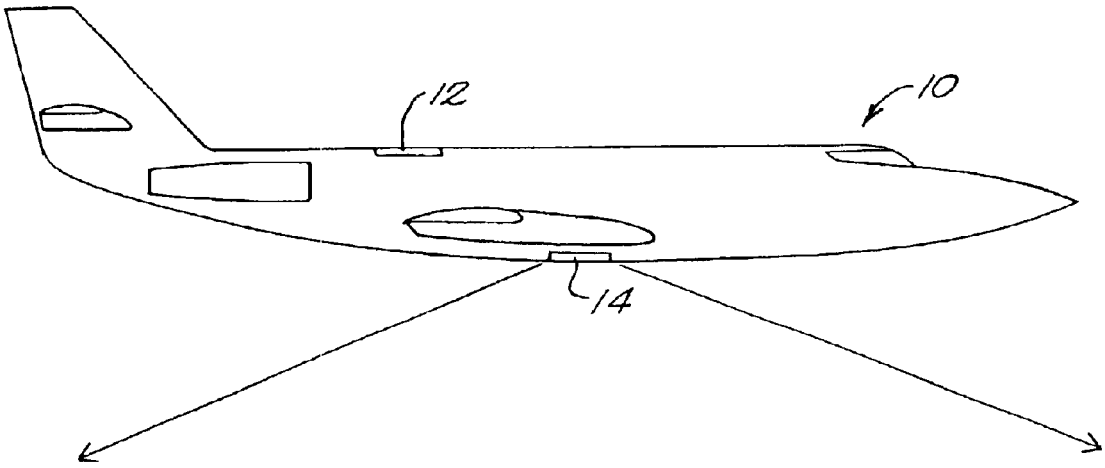
FIG. 1 is diagrammatic illustration of the utilization of wideband antennas on an aircraft, indicating their use for satellite communications and for VHF terrestrial communications.

Referring now to FIG. 1, in an aircraft application an aircraft 10 often times is provided with a UHF satellite communication antenna 12 on the top of the aircraft and/or a UHF communications antenna 14 at the belly of the aircraft. The purpose of the satellite communications antenna is, for instance, not only to establish two-way communications between the aircraft and a satellite but also to receive, for instance, GPS, GLONASS or Galileo navigation signals.

As to aircraft communications, there are aircraft bands lying in the VHF and UHF bands. Also at 220 MHz there is a vehicle band for vehicle tracking, communications and dispatch.

Figure 2:
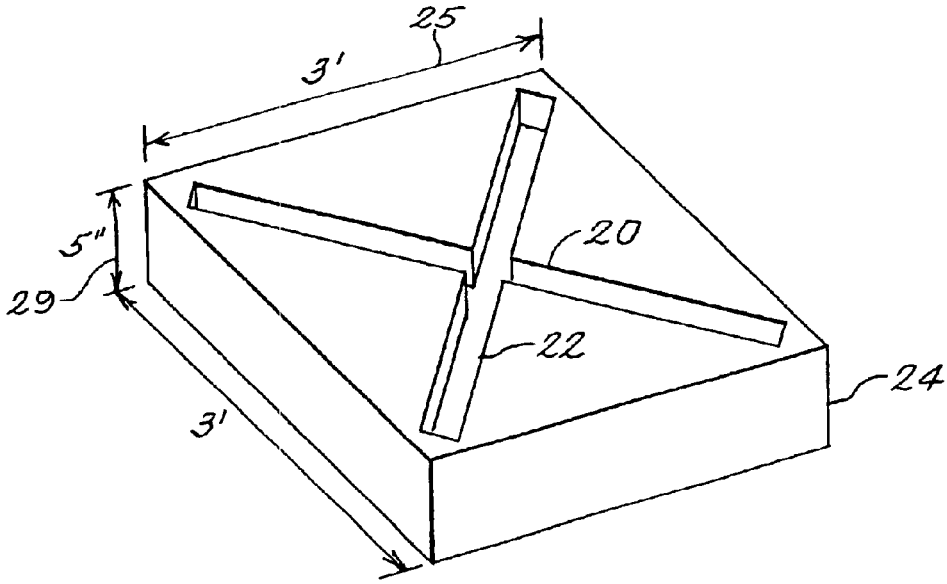
FIG. 2 (Prior Art)
FIG. 2 is a diagrammatic illustration of a crossed-slot antenna used in the prior art for wideband applications in which the antenna is carried in a cavity, but is unusually large in terms of the area occupied.

It will be appreciated that wideband antennas for such diverse applications are in fact quite large. For satellite communications alone, for a flush mounted crossed slot antenna, the overall real estate in one type of application is 30 inches by 30 inches, with a cavity depth of five inches. Such a prior art antenna is illustrated in FIG. 2 in which cross-slots 20 and 22 are located within a cavity 24 which has a 30-inch by 30-inch top surface and a five-inch depth as indicated by arrows 25, 27 and 29 respectively. This antenna is typically utilized for the 225 to 400 MHz range. However, its large size at one yard by one yard is difficult to justify in terms of real estate for use on an aircraft, especially when large numbers of antennas are to be utilized. If one where to reduce the antenna size by using above-the-ground plane meander line loaded antennas, these antennas would have a height of at least five inches and sometimes ten inches above the skin of the aircraft. As will be described, this produces turbulence and other factors which make this type of antenna undesirable.

Figure 3:
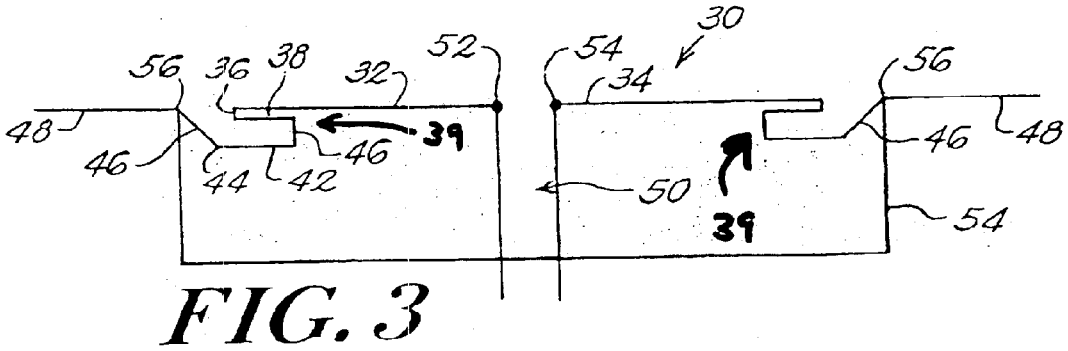
FIG. 3 is a diagrammatic and side view of the subject meander line loaded antenna illustrating its location within a cavity such that the top plates of the meander loaded antenna are flush with the surface surrounding the top edge of the cavity.

Referring now to FIG. 3, in the subject invention a meander line loaded antenna 30 includes top plates 32 and 34 for two diametrically opposed quad type antennas in which one edge of the top plate for each antenna is joined by a member 36 to a folded back portion 38 of the meander line 39 which is in turn joined to a downwardly depending portion 46 and to a folded back portion 42 of the meander line, having its distal end 44 connected by a member 46 to a ground plane 48 in the form of a conductive sheet. Ground plane 48 corresponds to the surface below which all of the antenna parts are mounted in this flush mount configuration. It will be noted that section 38 is a low impedance section, whereas section 42 is the high impedance section of the meander line. It will be appreciated that the antennas are fed by a balanced line indicated at 50 between points 52 and 54 on the opposed plates.

As illustrated, circumferentially attached to the ground plane is a submerged conductive cavity 54 which is joined both to ground plane 48 and to conductive elements 46 at an upper lip or periphery illustrated at 56. Thus, in essence all the meander line components of the antenna are within cavity 54 operated through the conductive sheet at an aperture there through.

The size of the cavity is described in terms of the cavity volume which in one embodiment is greater than $0.003\ \lambda^3$, where $\lambda$ is associated with the lowest frequency at which the antenna is to operate.

The bandwidth of the antenna is determined in part by the volume of the cavity. For an antenna which is to operate between 200 MHz and 2 GHz in one embodiment of the cavity its volume is the result of a top area of 11×11 inches, whereas the depth of the cavity is approximately five inches as determined by the Chu-Harrington formula. For antennas which are to operate in the range from 900 MHz to 3 GHz, the depth of the cavity can be reduced to one inch and the overall size of the antenna can be reduced to 2.9×2.9 inches.

Thus, for a wideband width antenna the overall size of the antenna is 11×11 inches by five inches in depth, whereas for a higher frequency antenna this is reduced to 2.9×2.9×1 inches in overall size.

Figure 4:
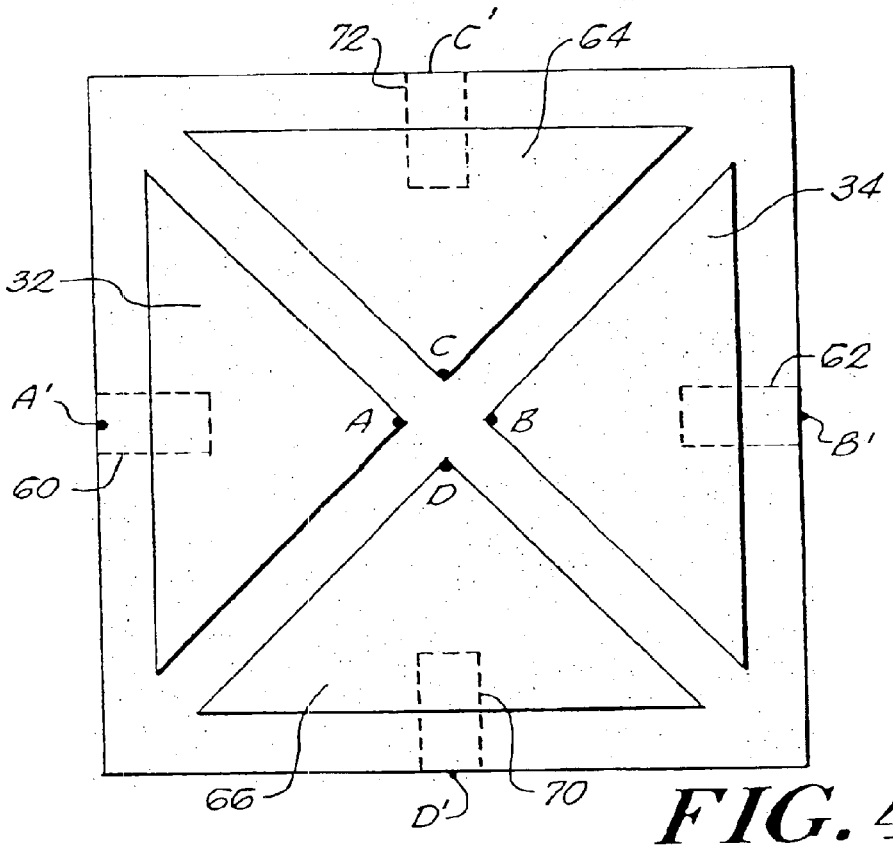
FIG. 4 is a diagrammatic and top view of the meander line loaded antenna of FIG. 3, illustrating a quad configuration of triangularly-shaped antenna elements to be able to generate outputs corresponding to right hand circular polarized and left hand circular polarized signals.

Referring now to FIG. 4, in one embodiment a quad type antenna is illustrated in which plates 32 and 34 of opposed triangular-shaped quad elements are illustrated with the associated meander line structures indicated in dotted outline at 60 and 62. The feed points for these triangular-shaped quad elements are shown at A and B, whereas for orthogonally oriented elements 64 and 66 the feed points are illustrated at C and D. Note, related meander line structures 70 and 72 are illustrated in dotted outline.

Figure 5:
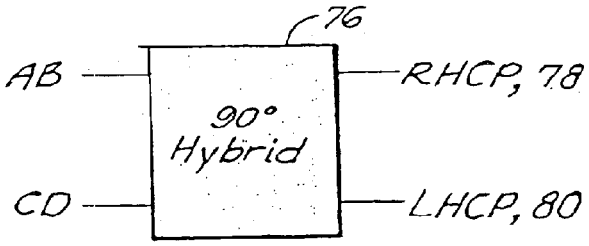
FIG. 5 is a block diagram illustrating the inputs to a 90-degree hybrid in which various outputs from the quad antenna elements of FIG. 4 are processed to produce right hand circular polarized signals and left hand circular polarized signals.

When, as illustrated in FIG. 5, feed point pairs AB and CD are coupled to a 90 degree hybrid, then the outputs of the hybrid are right hand circular polarized signals as illustrated at 78 and left hand circular polarized signals as illustrated at 80.

It will be appreciated that the recovery of right hand circular polarized and left hand circular polarized components is important in satellite communications. This is also important for terrestrial communications to establish 360-degree horizontal coverage.

Figure 6:
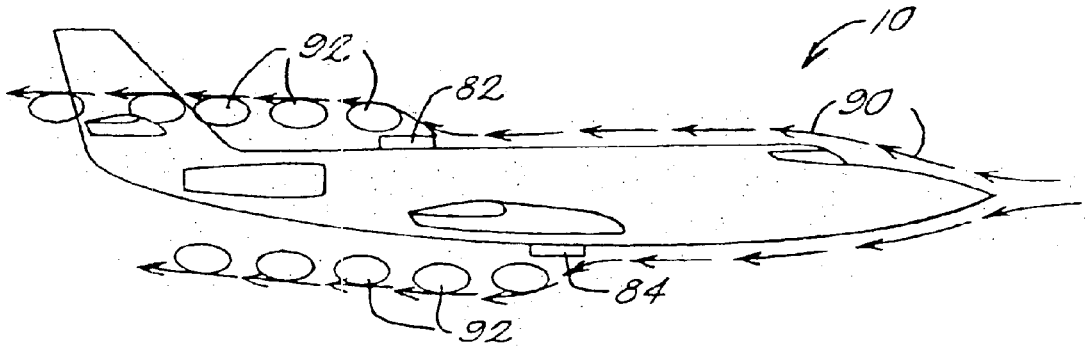
FIG. 6 (PRIOR ART)
FIG. 6 is a diagrammatic illustration of the turbulence generated by an aircraft when non-flush mount antennas are utilized at the skin of the aircraft, with non-submerged meander line loaded antennas adding as much as five inches above or below the skin of the aircraft when the antennas are operated in a band between 200 MHz and 2 GHz.

Referring to FIG. 6, it will be appreciated that were an aircraft 10 provided with traditional meander line above-the-ground plane antennas as illustrated at 82 and 84, then the airflow as illustrated generally at 90 would be turbulent at areas 92 aft of these antennas due to the sharpe edges of the antennas which protrude from the skin of the aircraft. This limits the efficiency of the aircraft, with such protruding structures to be avoided.

Figure 7:
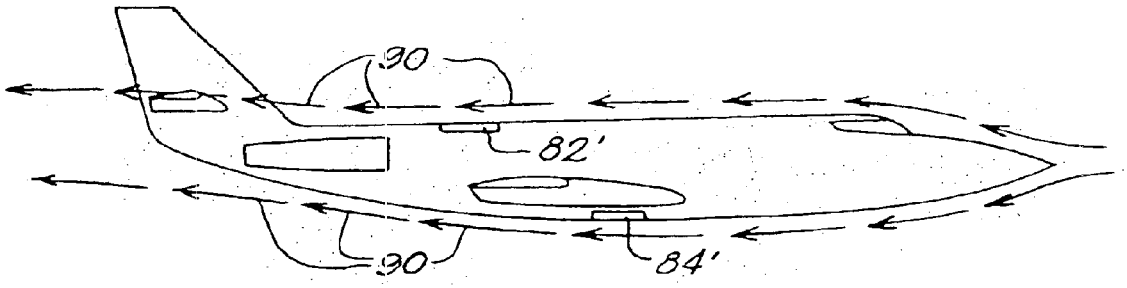
FIG. 7 is a diagrammatic illustration of embedded flush mounted meander line loaded antennas indicating the lack of turbulence generated when these antennas are flush-mounted to the skin of the aircraft.

Referring to FIG. 7, if these antennas here illustrated at 82' and 84' are flush mounted, then air streams 92 are linear over the skin of the aircraft, with the concomitant efficiency associated with laminar flow.

It will be appreciated that while circular polarized antennas can be provided through the subject quad configuration shown in FIGS. 4 and 5, a vertically polarized embodiment is possible with a different feed figuration. In this case elements having feed points at A, B, C and D which corresponds to the junctures of elements 46 with ground plane 48 for the various quad components, by feeding the antennas in this manner a vertically polarized antenna is achieved. What this means is that all of the antenna components are fed in phase.

Figure 8:
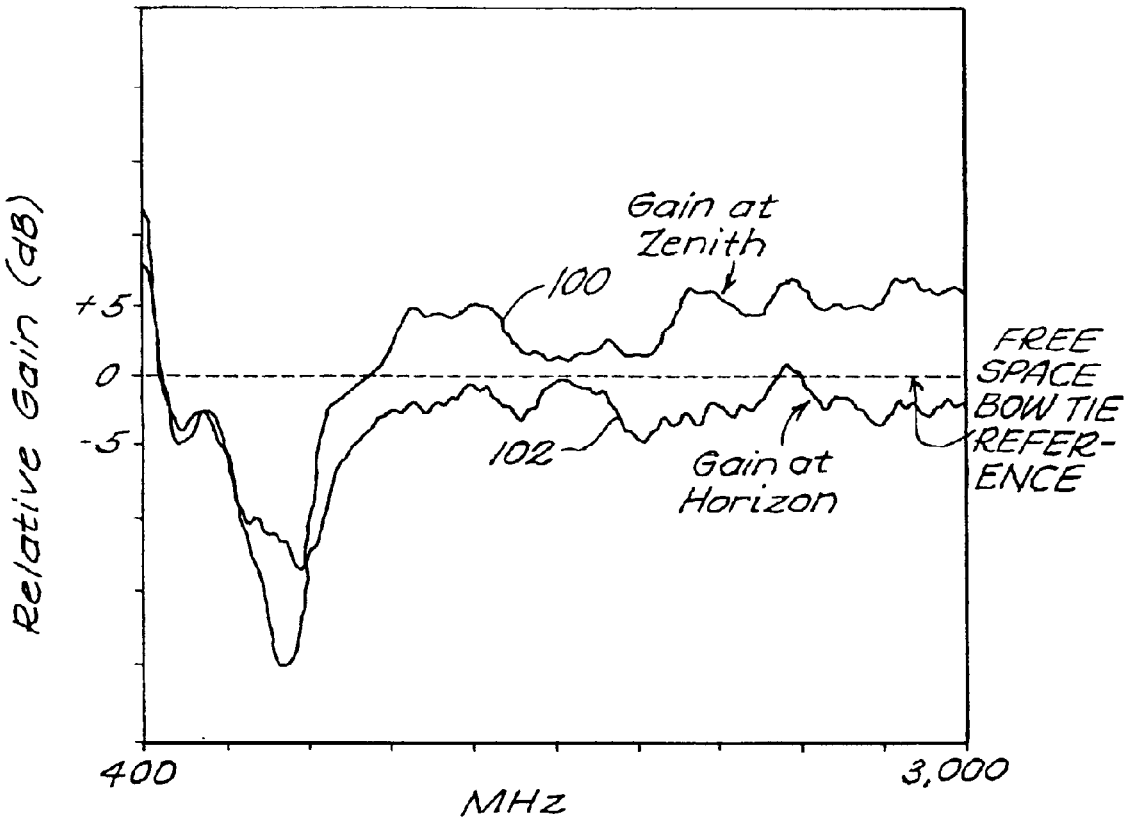
FIG. 8 is a graph of a relative gain at the zenith and at the horizon versus frequency for a 2.9 inch by 2.9 inch by 1.1 inch cavity size indicating gains at that one would associate with meander line loaded antennas in an above-the-ground plane configuration; and, FIGS. 9A and 9B are diagrammatic illustrations of a wireless handset in which the thickness or width of the wireless handset maybe decreased by embedding the meander line loaded antenna such that its top surface is flush with a surrounding ground plane.

Referring now to FIG. 8, what is shown is a graph of the gain of the antennas depicted in FIGS. 3 and 4 at the zenith and at the horizon as compared with a free space bow tie reference antenna. The relative gain is shown vis a vis the bow tie reference for frequencies starting at 400 MHz and in excess of 3 GHz. What can be seen here is that the gain at the zenith here illustrated at 100 is in the five dB range, whereas the gain at the horizon as illustrated at 102 is about zero dB, both consistent with the operation of above-the-ground plane meander line load antennas. The graph presented in FIG. 8 is for circular polarization loop type antennas.

Figure 9A:
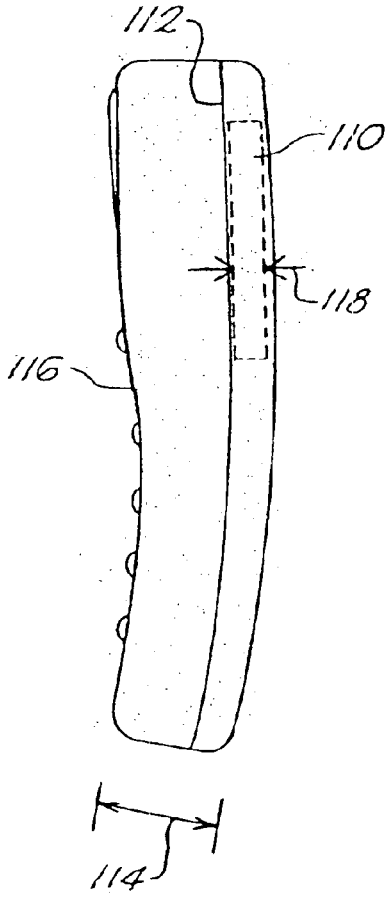
FIG. 9A (PRIOR ART)
Figure 9B:
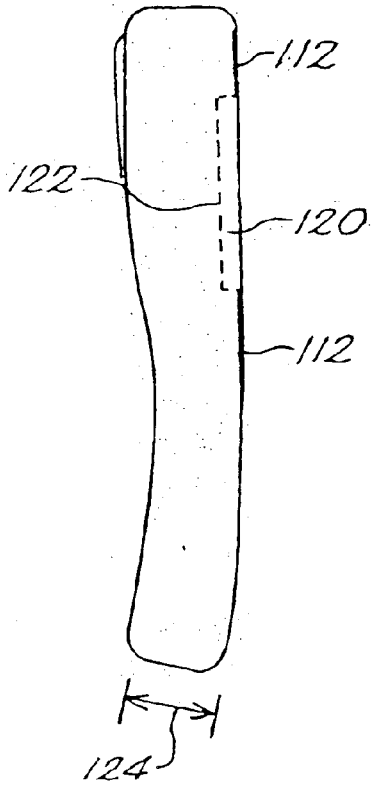
Figure 1:
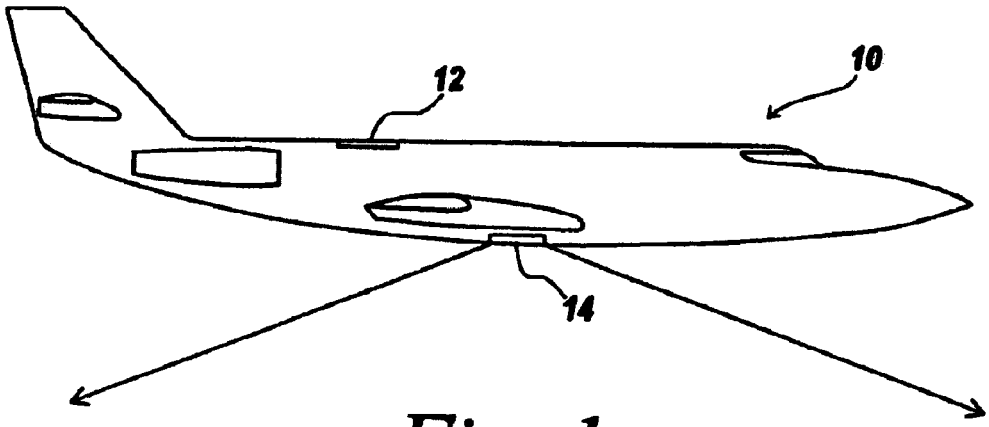
Figure 2:
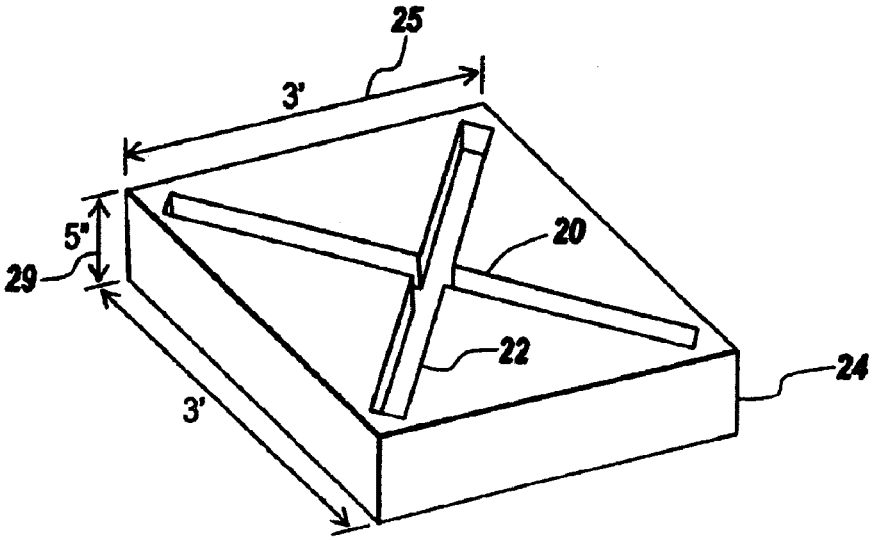
Fig. 2 (Prior Art)
Figure 3:
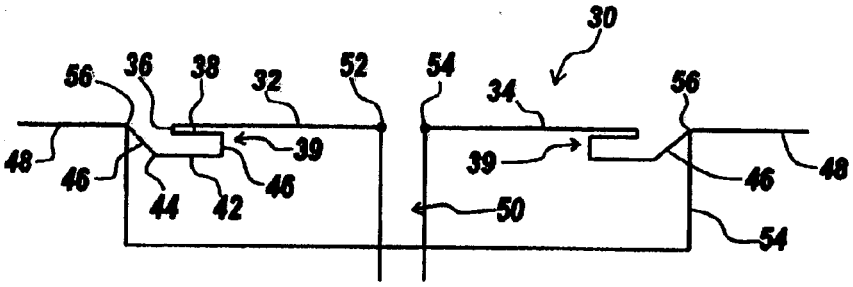
Figure 4:
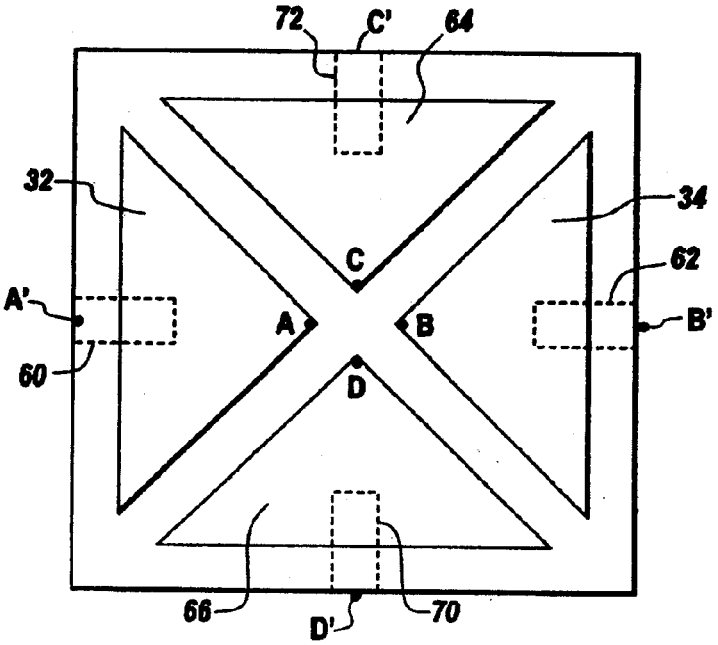
Figure 5:
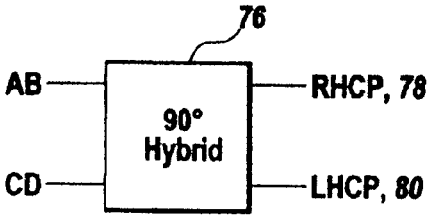
Figure 6:
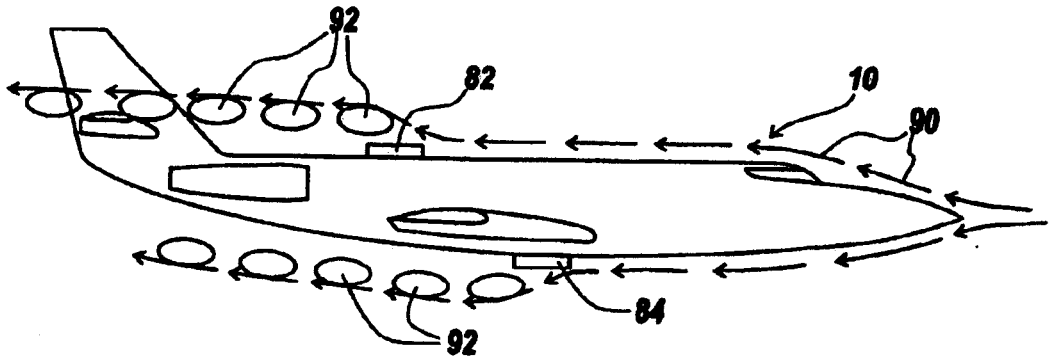
Fig. 6 (Prior Art)
Figure 7:
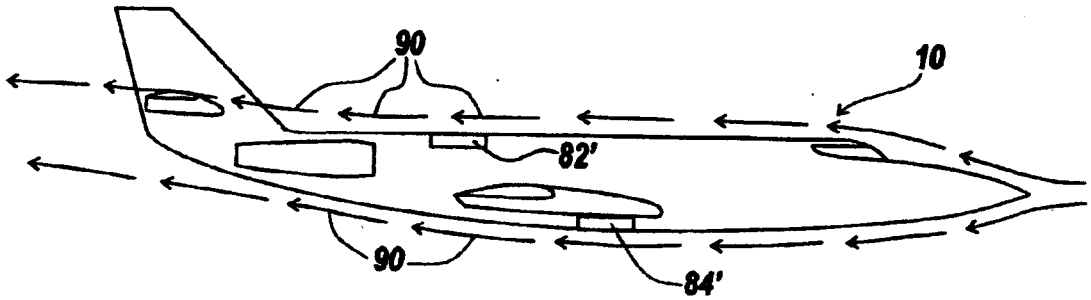
Figure 8:
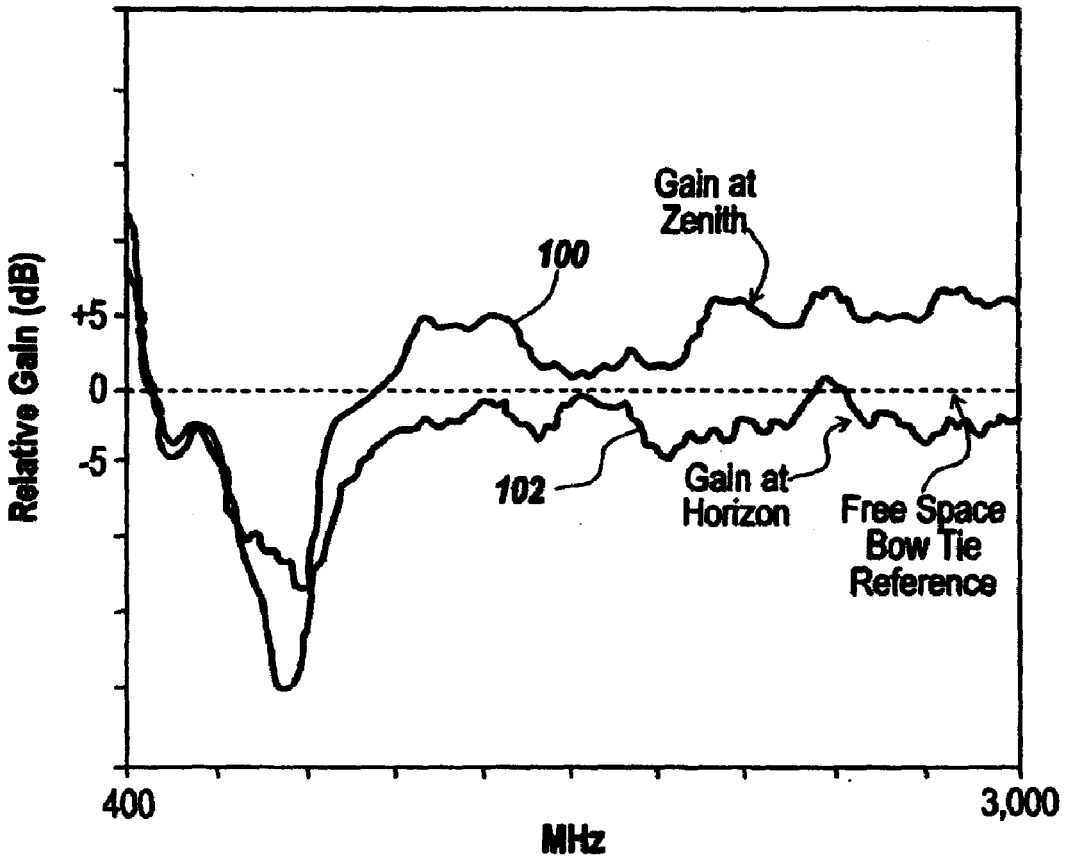
Figure 9A:
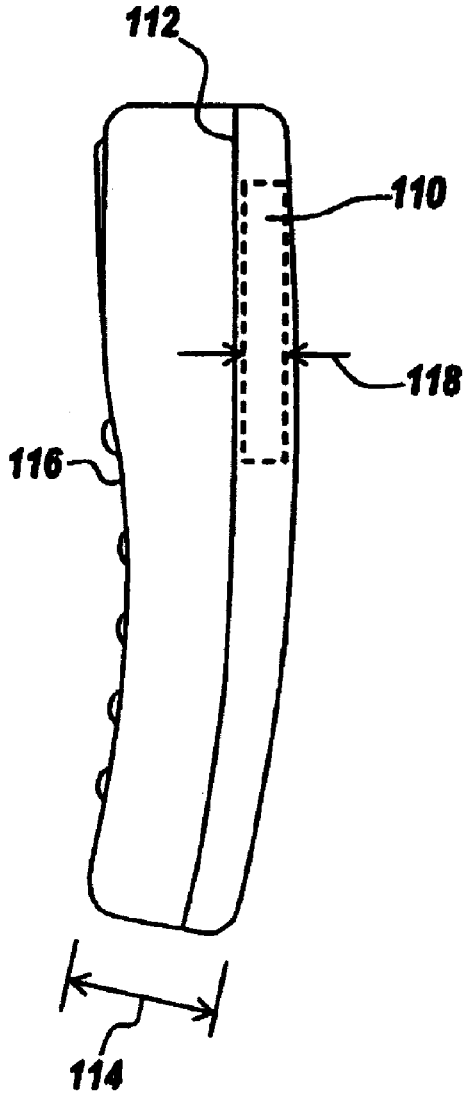
Fig. 9A (Prior Art)
Figure 9B:
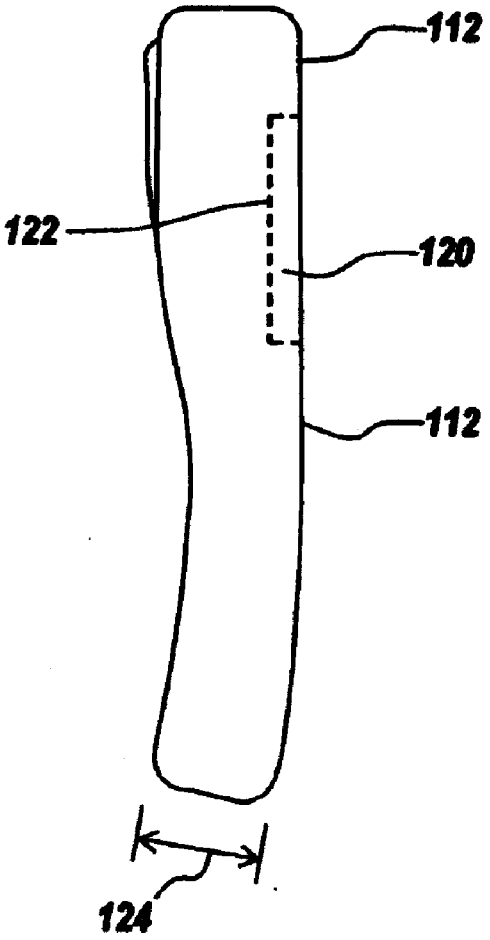

Referring now to FIGS. 9A and 9B, while the subject flush mount antenna has been described in connection with aircraft use, for hand portable devices such as wireless hand sets or for laptop applications, as illustrated in FIG. 9A in the past one had to mount an antenna 110 above a ground plane 112 such that the device thickness as illustrated by arrows 114 had to accommodate both the distance from the ground plane to the front 116 of the device and also the height 118 of the above-the-ground plane antenna plates. This means that for mobile or hand held devices the thickness depth of the device had to be increased to accommodate the above-the-ground plane antenna structure.

Referring to FIG. 9B, an internal flush mount antenna 120 is illustrated located in a cavity 122 surrounded by ground plane 112 such that the overall thickness or depth as illustrated by arrows 124 is significantly less than that associated with the same device as illustrated in FIG. 9A.

What will be appreciated is that with the flush mount internal antenna one is able to design a hand held or portable device which is thinner than would otherwise be possible utilizing an above-the-ground plane antenna. Moreover, the device with the flush mount internal antenna is mechanically more robust since the antenna is not subject to breaking off as would be the case with an above-the-ground plane antenna or in fact a whip antenna.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A flush mount meander line loaded antenna having a plate and an associated meander line located within an open conductive cavity such that the top surface of said plate is exposed at the opening of said cavity, said antenna including a conductive ground plane sheet having an aperture therethrough, said cavity having an upper lip electrically connected to said sheet at said aperture.

2. The antenna of claim 1, wherein the volume of said cavity is greater than $0.003\ \lambda^3$ with $\lambda$ relating to the lowest frequency at which said antenna is to operate.

3. The antenna of claim 1, wherein said antenna includes a number of plates and associated meander lines and wherein said plates are triangularly shaped.

4. The antenna of claim 3, wherein there are four of said plates mounted in said cavity in a quad configuration.

5. The antenna of claim 4, and further including a 90° hybrid having a pair of inputs and a pair of outputs, said inputs connected to feed points of opposed plates, said pair of outputs carrying right hand circular polarized and left hand circular polarized signals respectively.

6. The antenna of claim 1, wherein said plate has an outer edge spaced from an adjacent upper lip of said cavity, and wherein said meander line is connected between said outer edge and an adjacent portion of the upper lip of said cavity.

7. The antenna of claim 4, wherein said plates are fed in phase to provide a vertically polarized antenna.

8. The antenna of claim 4, wherein said plates are fed to provide a circularly polarized antenna.

9. A method for providing a wide bandwidth miniaturized antenna flush mounted to a conductive surface, comprising the steps of:

providing a meander line loaded antenna having a wide bandwidth response; and, embedding the meander line loaded antenna in an open conductive cavity connected at the top lip thereof to the conductive surface and exposed through an aperture in the conductive surface, whereby the advantages of a wide bandwidth meander line loaded antenna are achieved in a flush mount configuration.

10. The method of claim 9, wherein the conductive surface functions as a ground plane.

11. The method of claim 9, wherein the volume of the cavity is greater than $0.003\ \lambda^3$, with $\lambda$ relating to the lowest frequency at which said antenna is to operate.

12. A method for providing a wideband reduced-size antenna flush mounted to a conductive surface to avoid the necessity of providing the antenna with a large cover, comprising the steps of:

providing a wideband meander line loaded antenna; and, embedding the wideband meander line loaded antenna in a conductive cavity opened through the conductive surface, the cavity thereof having a periphery at the opening thereof electrically coupled to the conductive surface.

13. The method of claim 12, wherein the antenna is mounted in the skin of a moving vehicle, with the flush mounting preventing turbulent flow at or downstream from the antenna.

14. The method of claim 13, wherein the vehicle is an aircraft.

15. The method of claim 13, wherein the vehicle is a land vehicle.

16. A method of reducing the thickness of a handheld device requiring a wide band antenna and having a conductive case comprising the steps of:

providing a wideband meander line loaded antenna; and, embedding the antenna in a cavity submerged from a surface of the conductive case such that the cavity is exposed through an opening in the conductive surface, the cavity having a periphery at the opening electrically connected to the conductive surface at the opening, whereby the antenna is flush mount to the case so as not to increase the thickness thereof.

17. The method of claim 16, wherein the handheld device is a wireless handset.

18. The method of claim 16, wherein the handheld device in a laptop computer.

19. A method of providing a mechanically robust wideband antenna for a handheld device, comprising the steps of:

providing a meander line loaded antenna; and, embedding the antenna in a cavity submerged in a conductive surface of the device such that the cavity is exposed through an opening in the conductive surface and having a periphery at the opening electrically connected to the conductive surface surrounding the opening, thus to avoid elements which stick out from the device which are easily damaged or broken off.

* * * * *

UNITED STATES PATENT AND TRADEMARK OFFICE

CERTIFICATE OF CORRECTION

PATENT NO. : 6,833,815 B2
DATED : December 21, 2004
INVENTOR(S) : John T. Apostolos It is certified that error appears in the above-identified patent and that said Letters Patent is hereby corrected as shown below:

The title page should be deleted and substitute therefore the attached title page.

Delete drawings sheets 1-9B, and substitute therefore the drawing sheets, consisting of Figs. 1-9B as shown on the attached pages.

Signed and Sealed this

Twenty-seventh Day of September, 2005

JON W. DUDAS
*Director of the United States Patent and Trademark Office*

(12) United States Patent
Apostolos

(10) Patent No.: US 6,833,815 B2
(45) Date of Patent: Dec. 21, 2004

(54) CAVITY EMBEDDED MEANDER LINE LOADED ANTENNA

(75) Inventor: John T. Apostolos, Merrimac, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 271 days.

(21) Appl. No.: 10/251,131

(22) Filed: Sep. 20, 2002

(65) Prior Publication Data

US 2004/0056801 A1 Mar. 25, 2004

(51) Int. Cl.[7] ..... H01Q 1/38

(52) U.S. Cl. ..... 343/700 MS; 343/744; 343/749

(58) Field of Search ..... 343/700 MS, 741, 343/744, 749, 829, 846

(56) References Cited

U.S. PATENT DOCUMENTS

| | | | | |
|---|---|---|---|---|
| 5,790,080 | A | 8/1998 | Apostolos | |
| 6,313,716 | B1 | 11/2001 | Apostolos | |
| 6,323,814 | B1 | 11/2001 | Apostolos | |
| 6,373,440 | B2 | 4/2002 | Apostolos | |
| 6,373,446 | B2 | 4/2002 | Apostolos | |
| 6,404,391 | B1 | 6/2002 | Apostolos | |
| 6,469,675 | B1 * | 10/2002 | Jo et al. | 343/744 |
| 6,480,158 | B2 | 11/2002 | Apostolos | |
| 6,489,925 | B2 * | 12/2002 | Thursby et al. | 343/700 MS |
| 6,492,953 | B2 | 12/2002 | Apostolos | |
| 6,597,321 | B2 * | 7/2003 | Thursby et al. | 343/744 |
| 6,724,347 | B2 * | 4/2004 | Tomomatsu | 343/700 MS |

* cited by examiner

*Primary Examiner*—Shih-Chao Chen
(74) *Attorney, Agent, or Firm*—Daniel J. Long; Robert K. Tendler

(57) ABSTRACT

A wideband meander line loaded antenna is configured to be flush mounted to a conductive surface serving as a ground plane by embedding the meander line components within a conductive cavity surrounded at its top edge by the ground plane. The antenna thus looks out of a cavity recessed in the surface. By permitting flush mounting the meander line antenna, not only can the antenna dimensions be minimized due to the use of the meander line loaded antenna configuration, but in aircraft applications no part of the antenna exists above the skin of the aircraft, thereby to minimize turbulent flow. Moreover, when adapted to wireless handsets or laptop computers, the depth or thickness of the unit need not be increased when providing a wideband antenna, thus to minimize the overall dimensions of the device. Additionally, the flush mounted meander line antenna when utilized in the roof of a vehicle such as a car does not result in an unsightly protrusion from the top of the car, but rather is hidden in the recessed cavity, thereby permitting providing the vehicle with a wideband antenna which covers not only cellular frequencies but also the PCS band, the 802.11 band and GPS frequencies.

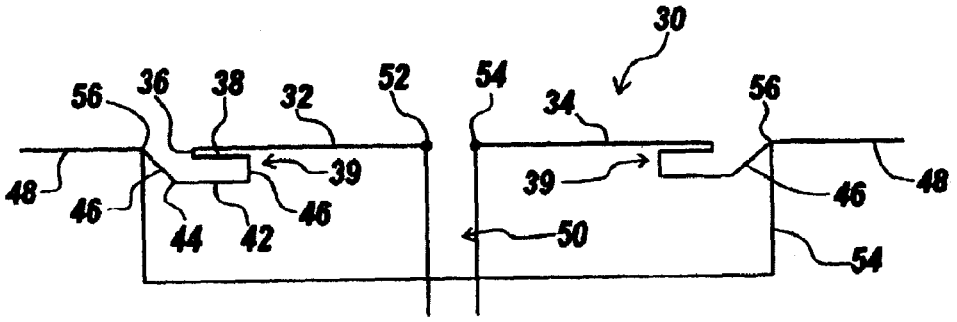

19 Claims, 5 Drawing Sheets